United States Patent [19]

Griffiths

[11] 4,196,313

[45] Apr. 1, 1980

[54] POLYPHONIC SOUND SYSTEM

[76] Inventor: Robert M. Griffiths, 96 Dawes Rd., London SW6 7EJ, England

[21] Appl. No.: 848,040

[22] Filed: Nov. 3, 1977

[30] Foreign Application Priority Data

Nov. 3, 1976 [GB] United Kingdom ..... 45818/76

[51] Int. Cl.[2] ..... G10H 3/08; H04R 5/00

[52] U.S. Cl. ..... 179/1 M; 179/1 GP; 84/1.16; 84/DIG. 27

[58] Field of Search ..... 179/1 M, 1 DM, 1 GP, 179/1 G; 84/1.15, 1.16, DIG. 1, DIG. 27

[56] References Cited

U.S. PATENT DOCUMENTS

| | | | |
|---|---|---|---|
| 2,122,010 | 6/1938 | Savage et al. | 179/1 G |
| 2,783,677 | 3/1957 | Becker | 179/1 G |
| 2,964,985 | 12/1960 | Webster | 84/1.15 |
| 2,976,755 | 3/1961 | Fender | 84/1.15 |
| 3,483,303 | 12/1969 | Warner | 84/1.15 |
| 4,010,668 | 3/1977 | Plueddemann | 179/1 M |
| 4,058,045 | 11/1977 | Jennings et al. | 84/DIG. 1 |

FOREIGN PATENT DOCUMENTS

| | | | |
|---|---|---|---|
| 1213712 | 2/1965 | Fed. Rep. of Germany | 84/1.16 |

OTHER PUBLICATIONS

"Sound Recording Practice", John Borwick, Oxford Univ. Press, 1976, p. 213.

*Primary Examiner*—Douglas W. Olms
*Attorney, Agent, or Firm*—Brisebois & Kruger

[57] ABSTRACT

The present invention concerns a polyphonic reproduction of sounds and particularly individual notes produced by musical instruments or the sounds produced by a group of instruments. In the invention the sounds are separated across a notional aural spectrum by using audio signals which vary differentially in amplitude for the varying sound sources. The variation may be caused either electrically or by varying the positions of the transducers picking up the sound sources.

2 Claims, 8 Drawing Figures

POLYPHONIC SOUND SYSTEM

The present invention concerns the stereophonic reproduction of sounds, and is particularly, though not exclusively, concerned with the stereophonic reproduction of electrically-amplified musical instruments during live or recorded performances.

It will be appreciated that an audible musical note is produced by vibrations having a particular fundamental frequency, this frequency determining its pitch. There are two basic methods by which the vibrations are produced in musical instruments. The first is by causing a solid member, either a string or a bar to vibrate by striking, plucking or bowing it, or by causing a column of air to resonate.

An example of a musical instrument which is frequently used with stereophonic amplification is the guitar. Transducers carried by the guitar itself pick up the vibrations from the guitar strings and generate amplitude-modulated electrical signals which are amplified in a stereo amplifier, the amplified signals being fed to loudspeakers which may be mounted on either side of a stage on which the guitar is being played. It will be appreciated that such a known arrangement will enable a member of an audience to hear the amplified tones of the guitar as if they were emanating from a particular spot with respect to other elerctrically-amplified instruments being played at the same time.

The present invention has for an object to take this "aural" positioning of the instrument a stage further so that individual or groups of notes produced by the instrument can be spread across a notional aural spectrum. Thus in the case of a guitar the notes from each string will apparently emanate from different places. In fact the invention can be taken still further and used to "spread" separate instruments forming part of a group or an orchestra across an aural spectrum. In this case each instrument will act as a single source of sound. Thus in the following description and claims whenever a sound source is referred to it will be understood that the term "sound source" can relate either to an individual instrument or to a part of an individual instrument, i.e. the string of a guitar.

Accordingly the present invention consists in a stereophonic reproduction system comprising transducer means operative to produce first and second electrical audio signals for each of a plurality of sound sources, and first and second sound reproduction means to which the respective first and second signals are supplied for reproduction, the transducer means being so arranged and/or connected that there is a predetermined amplitude difference between the pair of audio signals generated by each sound source the amplitude differences varying for each such pair of signals.

Figure 1:
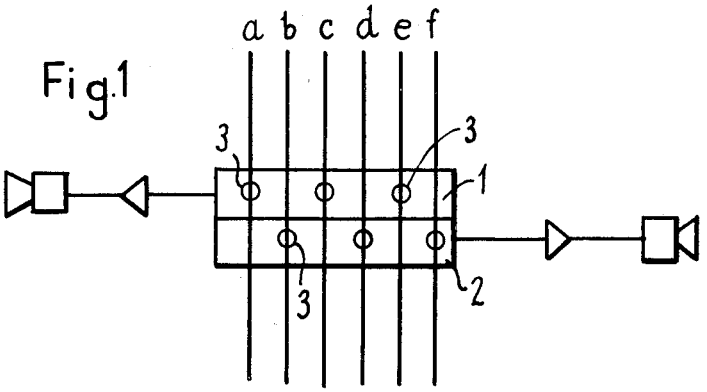
Figure 2:
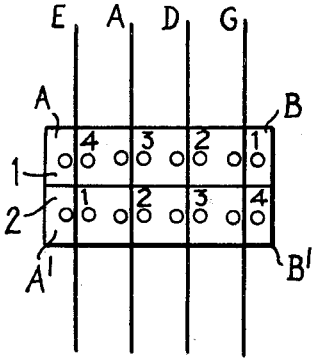
Figure 3:
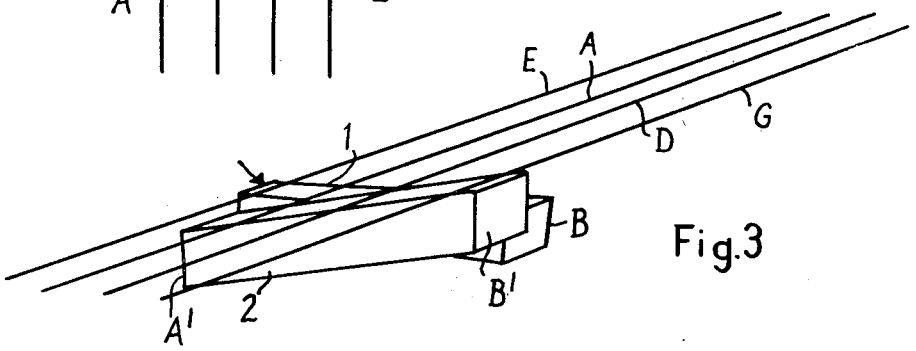
Figure 4:
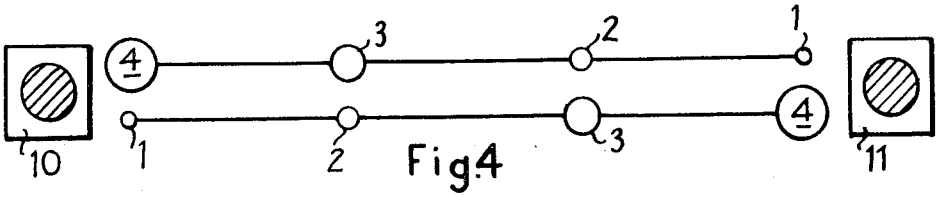
Figure 5:
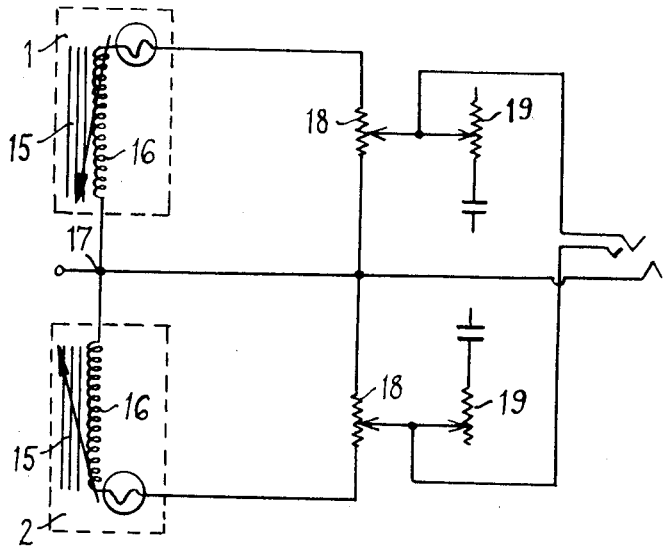
Figure 6:
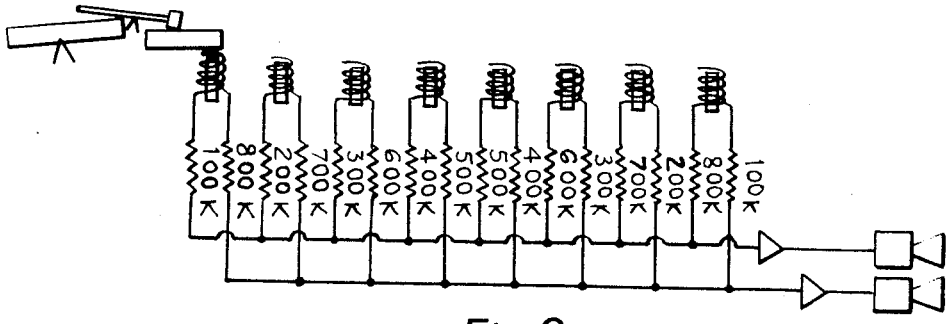
Figure 7:
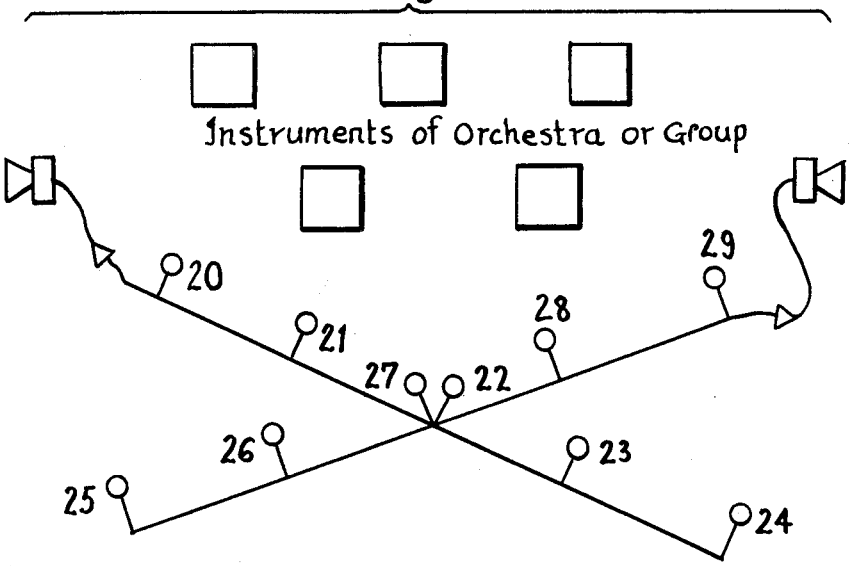
Figure 8:
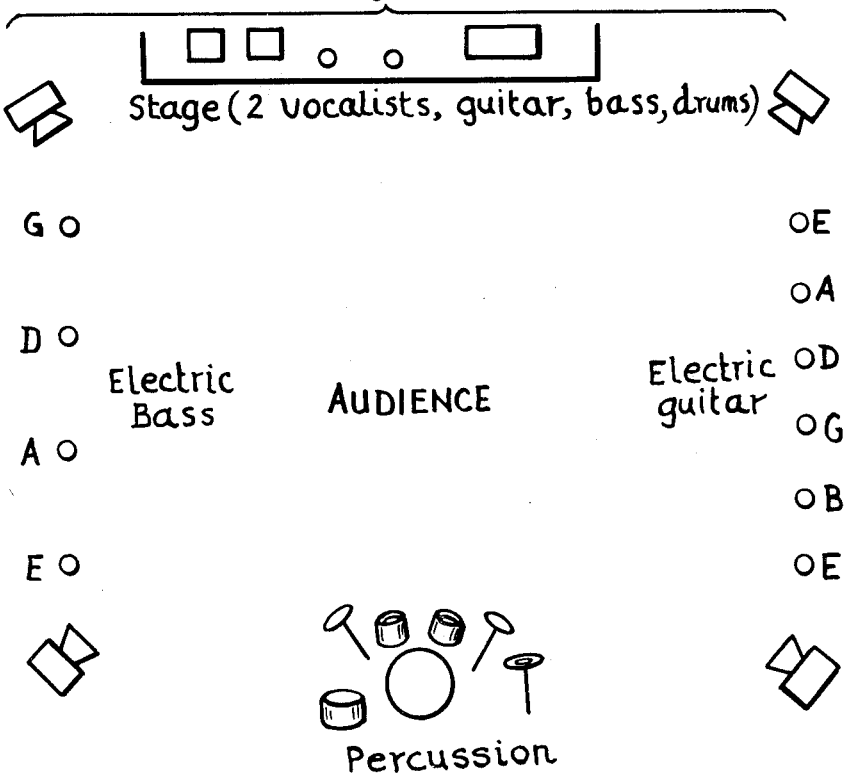

In order that the present invention may be more readily understood, an embodiment thereof will now be described by way of example, and with reference to the accompanying drawings, in which:

FIG. 1 is a plan view of part of a six-stringed guitar,

FIG. 2 is a plan view showing two pick-ups associated with a four stringed guitar and arranged in accordance with one embodiment of the present invention, FIG. 3 is a prespective view showing two pick-ups associated with a four stringed guitar and arranged in accordance with a second embodiment of the invention, FIG. 4 is a diagram showing the effects of a pair of pick-ups arranged as shown in FIG. 3, FIG. 5 is a circuit diagram of a stereo amplifier for use in the system of this invention, FIG. 6 is a circuit diagram showing an embodiment of the invention as applied to an electric piano, FIG. 7 shows a system according to the invention in use with several instruments, and FIG. 8 shows an embodiment of the invention using quadrophonic reproduction.

FIG. 1 shows a part of a six string guitar, the strings being made of steel and having been given the references a, b, c, d, e and f purely for clarity. Positioned below the strings are a pair of pick-ups or transducers 1.

These transducers are well known, and essentially consist of a magnetic core and an associated coil. The core is drilled to receive small metal cylinders 3 to enhance sensitivity. When the strings vibrate during playing, their vibrations induce currents in the coils associated with the magnets which are subsequently amplified for stereophonic reproduction in two or more speakers. In a conventional arrangement this will have the effect of producing an aural image of the guitar, such that the entire sound will apparently emanate from a position between the speakers which will depend on the balance of the stereo amplifier.

As will be apparent from FIG. 1 the cylinders 3 in the transducers are off-set with regard to one another. Because of this arrangement transducer 1 will be substantially more sensitive to the strings marked a, c and e than to the other strings, and transducer 2 will conversely be more sensitive to strings b, d and f. Thus when the loudspeakers associated with the transducers reproduce the guitar when it is played, the loudspeaker connected to transducer 1 will essentially reproduce the notes produced by strings a, c and e and the other loudspeaker will reproduce the notes produced by strings b, d and f. Naturally there will be some cross-over, but the effect to a correctly positioned listener will be to separate the sound of the guitar.

FIG. 2 shows the four strings of an electrically-amplified guitar. In the embodiment of FIG. 2 the cylinders 3 are not off-set but the transducers 1, 2 are inclined relative to the plane of the strings and to one another as is best seen in FIG. 2.

Thus end A of transducer 1 is the nearest part of the transducer 1 to the plane of the strings and end B the farthest away. Conversely end A' of transducer 2 is located farther from the plane of the strings than end $B^1$.

The result of this arrangement is that the transducer 1 has differential sensitivity to the four strings, the transducer being most sensitive to the E string, slightly less sensitive to the A string, still less sensitive to the D string and finally, least sensitive to the G string, the ratio between maximum and minimum sensitivity being of the order of 4 to 1. The sensitivity of transducer 2 is the converse to this.

FIG. 4 shows diagrammatically the effect of this differential sensitivity when the outputs from the two transducers are reproduced stereophonically on a pair of loudspeakers 10, 11; the speaker 10 receiving the amplified output of transducer 1 and the speaker 11 the output of transducer 2. In this diagram the circles represent amplitude or volume from notes of the same intensity, the upper line of circles representing the signals generated by transducer 1 from the four strings, and the lower line the signals from transducer 2.

It will be appreciated that when the loudspeakers 10 and 11 reproduce the notes with an intensity dependent on the sizes of the circles, each string will have an aural image which will be distinct from the other strings, the four images being spread across an aural spectrum and will appear to a listener at 12 to emanate from the four directions shown by the arrows in FIG. 3.

FIG. 5 shows a circuit diagram for a stereo amplifier suitable for use in the system above generally described. In this Figure, transducers 1 and 2 have magnetic cores 15 and associated coils 16; one end of each coil is connected to a common earth 17 and the other ends of the coils are connected to double-ganged tone and volume controls 18, 19 before being taken to a stereo jack socket.

It will be appreciated that an effect similar to that already described can be achieved by providing each string of the guitar with two separate pick-ups, each pick-up having its own amplifier. The gains of the amplifiers may then be varied to provide the required differential sensitivities.

It will of course be apparent that by suitably varying the differential sensitivities the various notes can be spread over an aural spectrum in an order which is different from the actual positions of the note-producing areas of the instrument. Furthermore the system described is not limited to use with guitars but may be used with a wide variety of musical instruments, stringed or otherwise.

An alternative method of obtaining an aural spectrum is shown in FIG. 6. In this Figure are shown the keys 30 of an electrical piano which through a suitable linkage cause hammers 31 to strike metal bars 32 to generate individual notes. Each bar 32 has its output divided into two branches, so as to produce first and second audio signals, each branch containing a variable resistance 34. If it is assumed that all the transducers produce audio signals of the sample amplitude, then the variable resistances 34 are each set so that the first audio signals, as taken from left to right in the Figure, have amplitudes which start at a peak at the left and successively decrease, whilst the amplitudes of the second audio signals vary in a complementary manner. In fact the amplitudes over the entire sound spectrum will vary in the same manner as shown in FIG. 4.

It will thus be apparent that, as in the previous embodiments, when the two sets of audio signals are reproduced by loudspeakers 35 the effect will be that the notes will again be spread across a notional aural spectrum.

It will also be appreciated that a single musical instrument could be replaced by a group of instruments, with microphones being used to pick up the sounds emitted by the instruments rather than transducers actually mounted in the instrument.

In such a case the microphones could be arranged as shown in FIG. 7. The outputs of microphones 20 to 25 are added and taken to one loudspeaker, and the output of microphones 26 to 30 added and taken to the other loudspeaker so that again the aural images of the instruments will be spaced apart.

It will be appreciated that the foregoing has been described in relation to stereophonic systems as being the simplest form of bi-aural reproduction. However it is of course entirely feasible for the same system to be modified for use with quadrophonic reproduction.

The present invention can also be used with systems using four loudspeakers positioned at the four corners of an auditorium. Thus a group consisting of two vocalists, electric guitar, electric bass and percussion and playing on the stage can be given the effect of entirely surrounding the audience as is shown in the diagram of FIG. 7. Thus a system similar to that described hereinbefore can be used to separate the individual notes of the guitar and bass as in the diagram.

It will be appreciated that the number of speakers can be increased in accordance with the number of stereo images to be presented.

It will also be appreciated that rather than using two transducers of the kind shown in FIG. 5 which are relatively inclined as shown in FIG. 3, it may be possible to use a transducer made from a single magnetic core and having associated therewith two coils which are inclined relative to one another in a manner similar to the transducer of FIG. 3 so as to provide the required differential sensitivity.

I claim:

1. In the combination of a stringed musical instrument with sound reproducing means, said sound reproducing means comprising:

(a) first and second pick-up means mounted beneath the strings of said instrument in operative association therewith (b) first and second sound reproduction means, and (c) means connecting both said first and second pick-up means to said first and second sound reproduction means, the improvement comprising that each pick-up means is so disposed in its operative relationship to said strings that it has a differential sensitivity to the sounds generated by said strings, the arrangement of said pick-up means being such that one pick-up means has a maximum sensitivity to a particular string and the other said pick-up means has a minimum sensitivity to the same said string, the sensitivities of said pick-up means varying for the remainder of the said strings in a complementary fashion whereby in operation the sounds of the strings when reproduced by said first and second reproduction means are spread across an aural spectrum in a relationship which corresponds to the spatial relationship between said strings themselves.

2. The combination of claim 1, wherein each pick-up means comprises a magnetic core associated with a coil, and wherein said magnetic cores are disposed beneath said strings and are inclined relative to one another to provide said differential sensitivity.

* * * * *